US007410621B2

(12) United States Patent
Muter et al.

(10) Patent No.: US 7,410,621 B2
(45) Date of Patent: Aug. 12, 2008

(54) MOUNTING ARRANGEMENT FOR CATALYTIC CONVERTER ELEMENT

(75) Inventors: John P. Muter, Toronto (CA); Haiqing (Henry) Liu, Richmond Hill (CA)

(73) Assignee: DCL International Inc. (CA)

( * ) Notice: Subject to any disclaimer, the term of this patent is extended or adjusted under 35 U.S.C. 154(b) by 522 days.

(21) Appl. No.: 11/037,812

(22) Filed: Jan. 18, 2005

(65) Prior Publication Data

US 2006/0159597 A1 Jul. 20, 2006

(51) Int. Cl.
*B01D 50/00* (2006.01)

(52) U.S. Cl. ..... 422/180; 422/168; 422/177

(58) Field of Classification Search ..... 422/168, 422/177, 179, 180; 60/301
See application file for complete search history.

(56) References Cited

U.S. PATENT DOCUMENTS

| | | | | |
|---|---|---|---|---|
| 3,441,381 | A | | 4/1969 | Keith et al. |
| 3,948,611 | A | | 4/1976 | Stawsky |
| 4,032,310 | A | | 6/1977 | Ignoffo |
| 4,161,509 | A | | 7/1979 | Nowak |
| 4,250,146 | A | | 2/1981 | Bailey |
| 4,279,864 | A | | 7/1981 | Nara et al. |
| 4,344,922 | A | * | 8/1982 | Santiago et al. ..... 422/179 |
| 4,362,700 | A | | 12/1982 | Hayashi et al. |
| 4,448,754 | A | | 5/1984 | Isogai et al. |
| 4,519,120 | A | | 5/1985 | Nonnenmann et al. |
| 4,598,063 | A | | 7/1986 | Retallick |
| 4,849,185 | A | | 7/1989 | Wittig |
| 5,169,604 | A | | 12/1992 | Crothers, Jr. |
| D351,608 | S | | 10/1994 | Cox |
| 5,589,142 | A | | 12/1996 | Gribbon |
| 5,746,986 | A | | 5/1998 | Pollock et al. |
| 5,829,250 | A | * | 11/1998 | Lane et al. ..... 60/301 |
| 2004/0031264 | A1 | | 2/2004 | Kojima ..... 60/311 |
| 2005/0284115 | A1 | | 12/2005 | Wen-Hsien |

OTHER PUBLICATIONS

Communication from European Patent Office re: related application.

* cited by examiner

*Primary Examiner*—Glenn Caldarola
*Assistant Examiner*—Tom Duong
(74) *Attorney, Agent, or Firm*—Harness, Dickey & Pierce, P.L.C.

(57) ABSTRACT

According to the present invention a catalyst substrate is provided with a peripheral mantle extending thereabout and having opposite end walls between which the substrate is disposed. At least one of the end walls acts as a forward seal which is maintained in close proximity with a corresponding sealing surface toward an inlet end of the catalytic converter housing. A retaining member is provided which maintains the sealing surfaces In close proximity to define a labyrinth seal therebetween.

7 Claims, 4 Drawing Sheets

MOUNTING ARRANGEMENT FOR CATALYTIC CONVERTER ELEMENT

FIELD OF THE INVENTION

This invention relates generally to catalytic converters for treating combustion gasses. More particularly this invention relates to the mounting of a catalyst substrate in a catalytic converter housing.

BACKGROUND OF THE INVENTION

A typical catalytic converter comprises a cylindrical catalyst substrate mounted within a cylindrical catalytic converter housing. The catalyst substrate may be a ceramic honeycomb or a corrugated metal foil sheet and a flat metal foil sheet wound together into a spiral defining a matrix of passages.

In either case the catalyst substrate defines a multiplicity of the flow passages extending therethrough generally parallel to an axis of the catalyst substrate and, when installed therein, the catalytic converter housing.

Catalytic converters may be broadly grouped into vehicle sized units and stationary engine or industrial sized units. Vehicle sized units are considerably smaller than industrial sized ones and accordingly are relatively easy to remove and to disassemble. Catalyst substrate diameters for vehicle sized units would typically measure less than a foot (approximately 0.3 m). In contrast, large industrial sized units may have catalyst substrate diameters that measure on the order of six feet (approximately 2 m). The associated ducting and sheer size of the components typically precludes removal and axial disassembly of an industrial sized unit for replacing the catalyst substrate. Instead, large industrial sized catalytic converter housings are provided with a lateral access port for removal of the catalyst substrate from a side of the housing without removal or axial separation of the housing from its associated ductwork.

In use the catalytic converter housing both during heat up and steady state operation will typically be about 100° C. cooler than the catalyst substrate. This is because the substrate typically runs at exhaust temperature and has nowhere to conduct or radiate heat away. The housing in contrast will receive heat from its inside but can radiate or conduct heat into the surrounding atmosphere. Upon shutdown or low engine loads, the rate of the temperature loss from the housing tends to be less than that of the catalyst substrate because the housing is of heavy gauge metal whereas the catalyst substrate is thin sheet metal with a huge surface area. The housing under low engine load conditions can be 100-150° C. hotter than the catalyst substrate.

Considering the overall size of an industrial sized unit, the temperature differential can result in significant dimensional differences between the housing and the substrate. These must be accommodated to avoid undue stress damaging either component while ensuring adequate sealing therebetween so as to avoid exhaust gasses escaping between the housing and the substrate.

Most large industrial catalytic converters are sealed about the periphery of the catalyst substrate with a ceramic fibre material. Unfortunately such material is prone to erosion by high velocity gasses and mechanical breakdown through compression and vibration. Furthermore such material is easily torn and difficult to maintain in place during installation, particularly with larger units.

It is an object of the present invention to provide a catalytic converter design which allows for differential thermal expansion between the catalytic converter housing and the catalyst substrate without the use of fibrous gasketing materials yet ensuring an effective seal to avoid excessive gas flow between the substrate and the housing.

SUMMARY OF THE INVENTION

In very general terms, according to the present invention a catalyst substrate is provided with a peripheral mantle extending thereabout and having opposite end walls between which the substrate is disposed. At least one of the end walls acts as a forward seal which is maintained in close proximity with a corresponding sealing surface toward an inlet end of the catalytic converter housing. A retaining member is provided which maintains the sealing surfaces in close proximity to define a labyrinth seal therebetween. In other words, the gap is small enough that the preferred gas flow route is through the substrate rather than past the seal.

More specifically, a catalytic converter is provided which has a housing with side walls defining a catalyst chamber, an inlet opening and an outlet opening communicating with an interior of the catalyst chamber to provide a fluid flow path through the housing from the inlet opening through the chamber and out of the outlet opening. A catalyst substrate is mounted in the chamber and has a flow direction aligned with the fluid flow path. The catalyst substrate has a peripheral mantle extending thereabout. The peripheral mantle has a peripheral outer wall and a pair of spaced-apart end walls extending inwardly therefrom. The catalyst substrate is disposed between the end walls with one of the end walls being a forward end wall upstream of the catalyst substrate and facing toward the inlet opening. The other of the end walls is a rearward end wall downstream of the catalyst substrate and facing toward the outlet opening. The housing has a sealing surface in the chamber transverse to the flow direction and facing a forward end wall of the peripheral mantle. Locating means are provided and secured to the housing for locating the catalyst substrate relative to the chamber. The locating means include engaging means for engaging the peripheral mantle to limit movement of the catalyst substrate away from the sealing surface to maintain the forward end wall in closely spaced arrangement with the sealing surface thereby defining a labyrinth seal therebetween. The labyrinth seal avoids fluid leakage between the housing and the catalyst substrate to promote fluid flow through the substrate. The chamber further has a lateral access port for removal or installation of the catalyst substrate therein without axial separation of the housing.

The locating means may be a bar having forward and rearward securing means respectively at forward and rearward ends thereof. The securing means secure the bar to the housing with the forward end upstream of the rearward end. The engaging means may be a tab extending from a side of the bar for abutting against the rearward end wall of the peripheral mantle. The tab may be dimensioned to bend at a force input below that required to damage the peripheral mantle.

The forward securing means may be configured to accommodate laterally outward movement of the peripheral mantle in response to thermal expansion. The rearward securing means may be configured to accommodate longitudinal expansion of the housing.

The forward securing means may be a transversely extending slot and the rearward securing means may be a longitudinally extending slot.

The catalyst chamber may accommodate first and second axially aligned catalyst substrates with the first substrate being upstream of the second substrate. In such a case, each of the first and second catalyst substrates may have a respective peripheral mantle extending thereabout with respective forward and rearward end walls. The locating means may include a first tab and a second tab adjacent the first tab. The first tab engages is the rearward wall of the first catalyst substrate to limit movement of the first catalyst substrate away from the sealing surface of the housing. The second tab may engage the forward wall of the second catalyst substrate to limit movement of the second catalyst substrate toward the first catalyst substrate.

The locating means may be marked to distinguish the forward end from the rearward end.

The marking may be the numeral "1" placed between the first tab and the forward end.

A method is provided for sealing a catalyst substrate in a catalytic converter housing wherein the housing has sidewalls defining a catalyst chamber, an inlet opening upstream of the catalyst chamber and an outlet opening downstream of the catalyst chamber. The inlet and outlet openings provide a fluid flow path through the housing which further has a lateral access port for installation and removal of a catalyst substrate in the catalyst chamber without axial separation of the catalyst chamber.

The method comprises the steps of:

(i) providing a peripheral mantle about the substrate, the peripheral mantle having first and second spaced apart inwardly extending walls with the substrate disposed therebetween;

(ii) providing the housing with an inwardly facing sealing surface extending about the inlet opening;

(iii) providing at least the first wall with an outwardly facing sealing surface for registering with the inwardly facing sealing surface of the housing;

(iv) providing a lateral locating means securable to the housing and having positioning means extending therefrom for engaging the peripheral mantle to limit movement of the peripheral mantle and the outwardly facing sealing surface away from the inlet opening and the inwardly facing sealing face to maintain a pre-determined gap therebetween; the gap forms a labyrinth seal transverse to the fluid flow path for restricting fluid leakage between the catalyst and the housing;

(v) providing a deflecting means acting between the locating means and the mantle for limiting the amount of force which may be applied by the locating means to the peripheral mantle to an amount which is below the yield strength of the peripheral mantle and the yield strength of the housing.

The deflecting means may extend from and be unitary with the locating means. The amount of force may be limited by the cross-sectional area of the deflecting means transverse to the flow direction.

A radial clearance may be provided between an outer periphery of the peripheral mantle and an interior of the catalyst chamber to accommodate relative differential thermally induced movement therebetween.

DESCRIPTION OF DRAWINGS

Preferred embodiments of the invention are described in detail below with reference to the accompanying drawings in which.

DETAILED DESCRIPTION OF THE INVENTION

Figure 2:
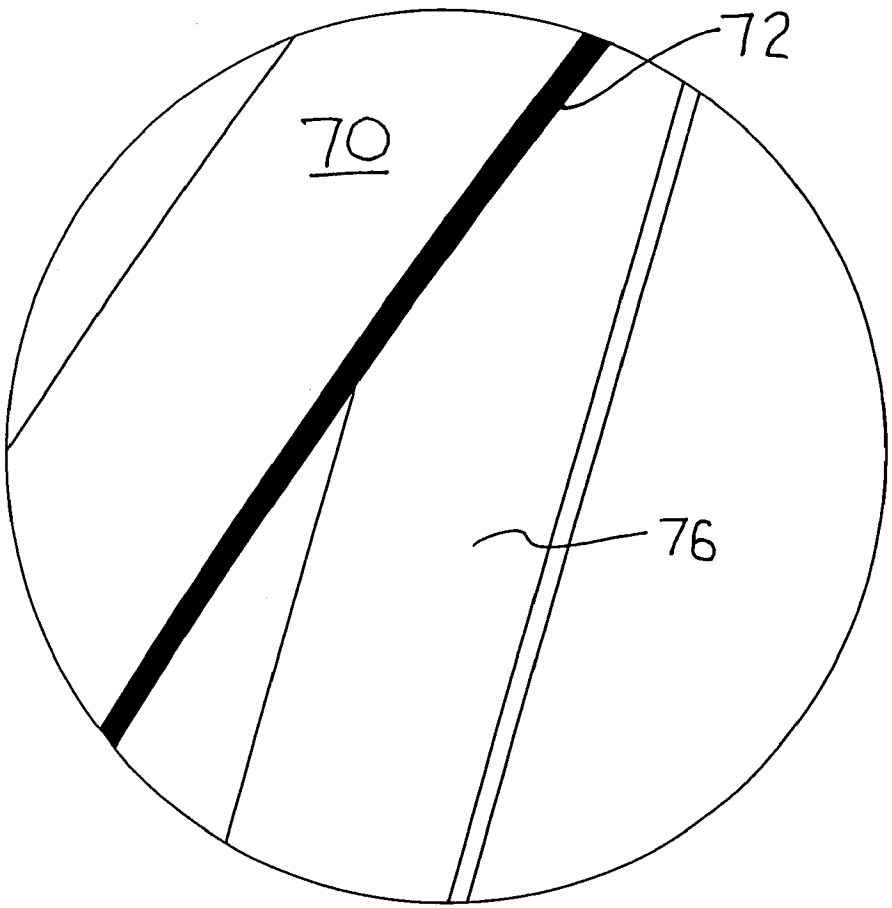
FIG. 2 is an enlargement of the encircled area 2 of FIG. 1.
Figure 1:
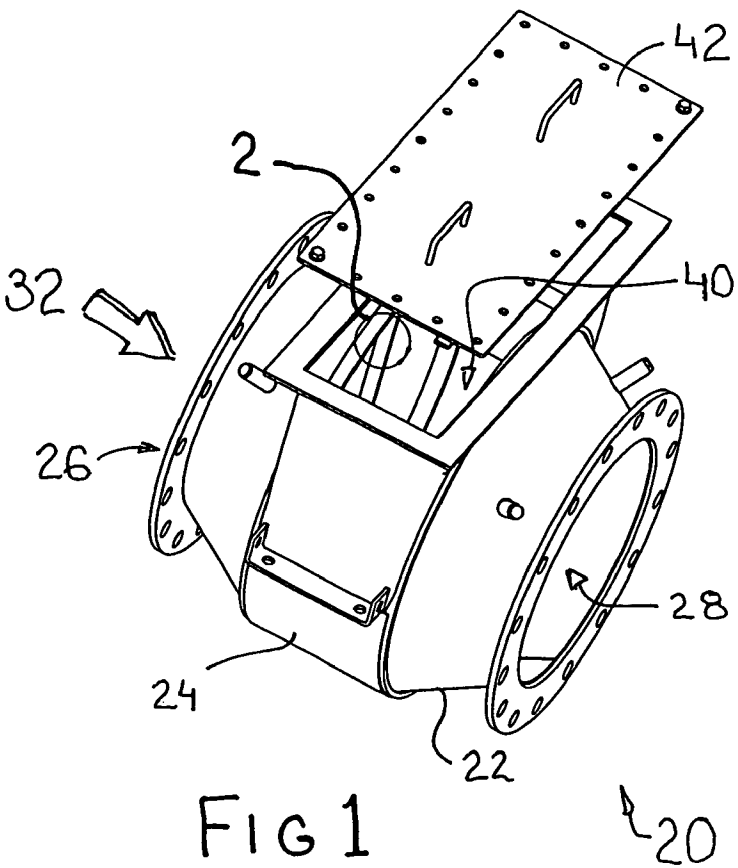
FIG. 1 is an exploded perspective view illustrating a housing for a catalytic converter according to the present invention.
Figure 4:
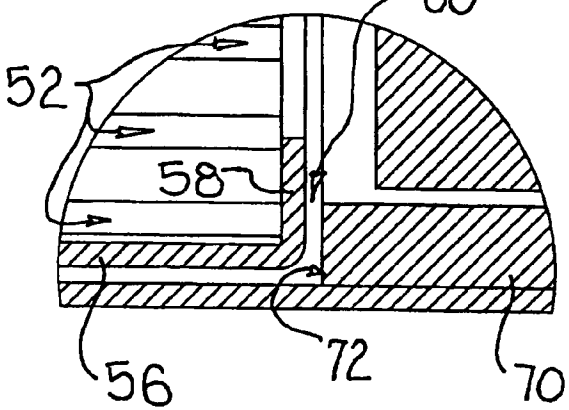
FIG. 4 is an enlargement of the encircled area 4 of FIG. 3.
Figure 3:
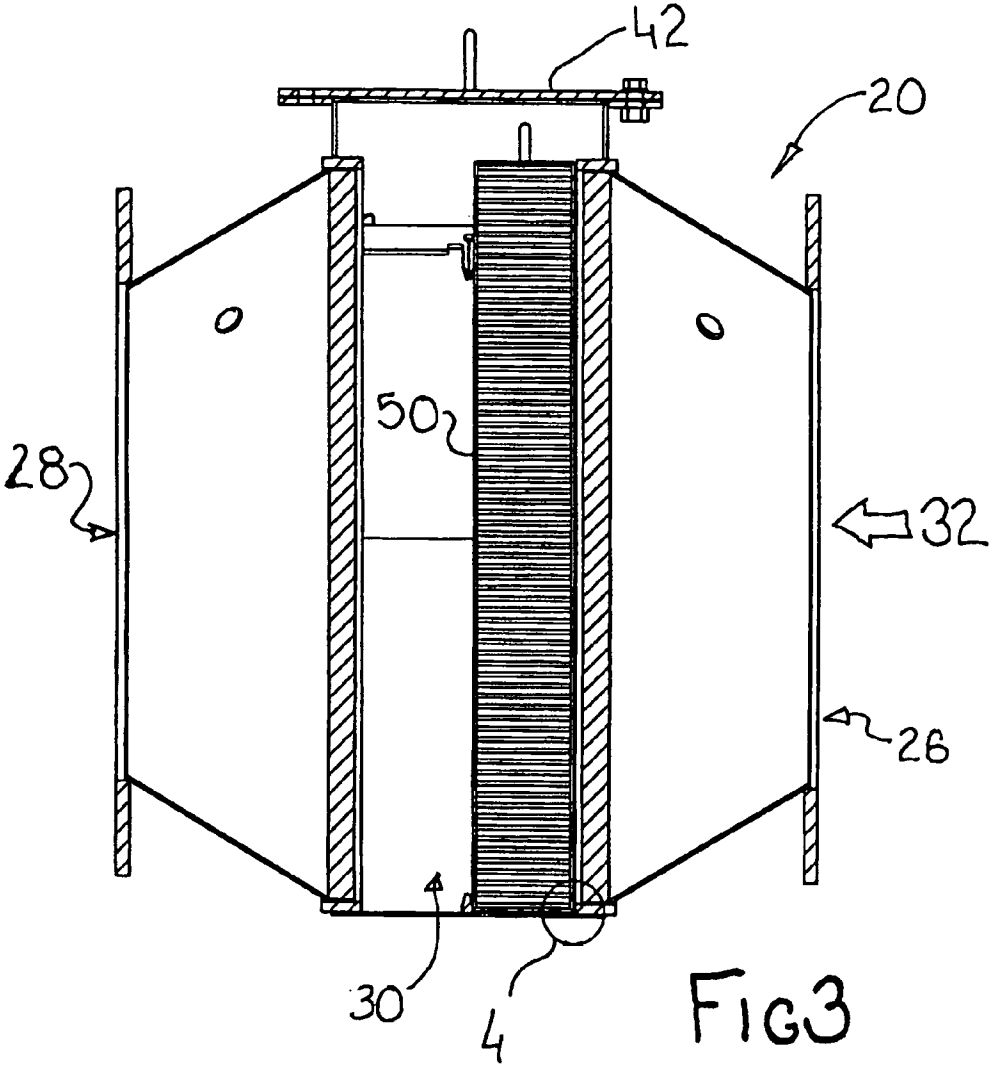
FIG. 3 is an axial section through a catalytic converter according to the present invention.
Figure 6:
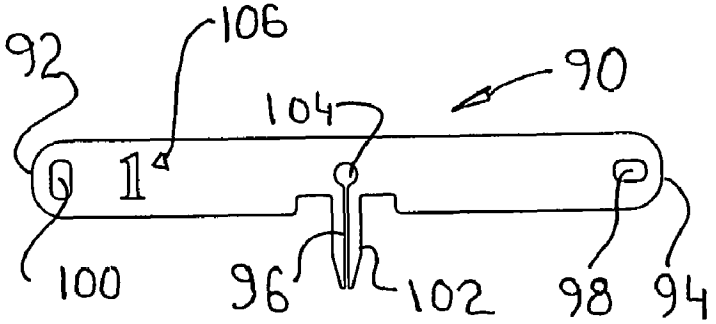
FIG. 6 is a plan view of a retaining bar for use with a catalytic converter according to the present invention.
Figure 5:
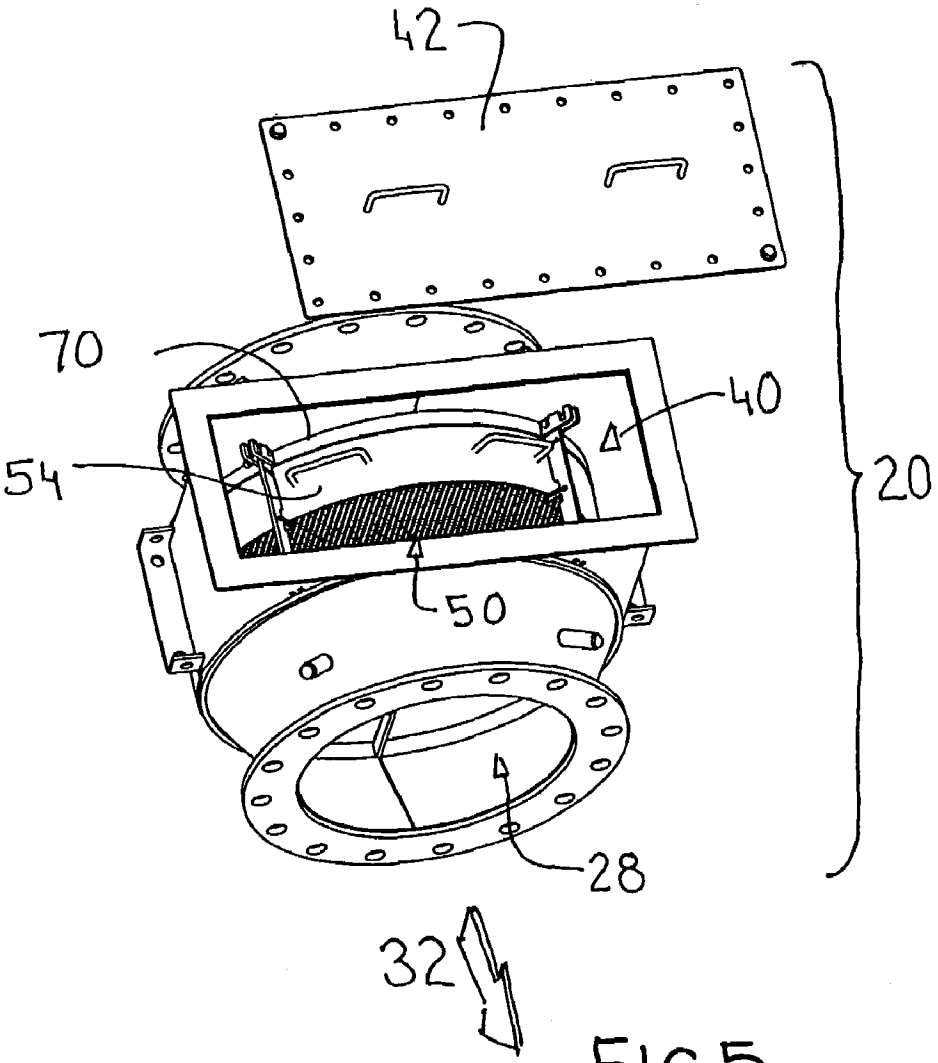
FIG. 5 is an exploded perspective view of a catalytic converter according to the present invention.
Figure 8:
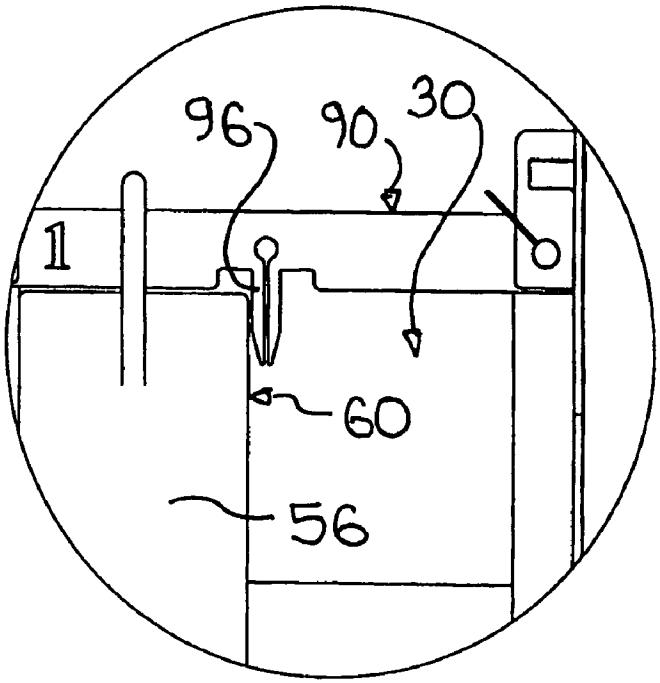
Figure 7:
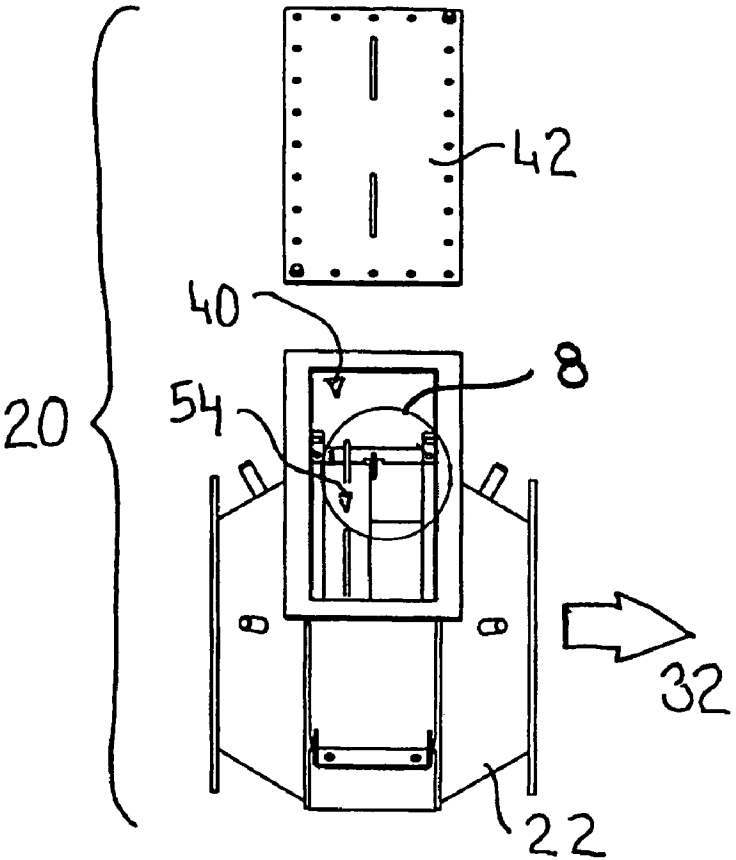
FIG. 7 is an exploded perspective view of a catalytic converter according to the present invention; and, FIG. 8 is an enlargement of the encircled area 8 of FIG. 7.

A catalytic converter according to the present invention is generally indicated by reference 20 in the accompanying illustrations. The catalytic converter 20 has a housing 22 with a generally cylindrical centre section 24 tapering at one end toward an inlet opening 26 and at an opposite end toward an outlet opening 28. The housing 22 defines a catalyst chamber 30. The inlet opening 26 and outlet opening 28 communicate with the catalyst chamber 30 to provide a flow path 32 for exhaust gasses from the inlet opening 26 through the chamber/housing 22 and out of the outlet opening 28.

The centre section 24 of the chamber 30 has a lateral access port 40 through the housing 22 through which a catalyst substrate 50 may be inserted into or removed from the chamber 30. A cover 42 is provided to close the access port and prevent exhaust gasses from escaping. The cover 42 may be secured with any suitable releasable fasteners such as nuts and bolts.

The catalyst substrate 50 is illustrated as a metal foil type and has a multiplicity of passages 52 extending therethrough generally aligned with the flow path 32. The catalyst substrate 50 has a peripheral mantle 54 extending thereabout. The peripheral mantle has a peripheral outer wall 56 and a pair of spaced-apart end walls extending radially inwardly therefrom. The end walls include a forward end wall 58 upstream of the catalyst substrate (i.e. facing toward the inlet) and a rearward end wall 60 downstream of the catalyst substrate (i.e. on the outlet side). The catalyst substrate 50 is nested in a channel defined by the peripheral outer wall 56, the forward end wall 58 and the rearward end wall 60. The nesting should be snug to avoid gas escape between the peripheral mantle 54 and the catalyst substrate 50. The housing has a lip 70 extending inwardly into the chamber upstream of the catalyst substrate 50. The lip 70 has a sealing surface 72 which faces the forward end wall 58 of the peripheral mantle 54. The sealing surface 72 and the forward end wall 58 are in close juxtaposition to define a labyrinth seal 80 therebetween.

A guide 76 such as the flat bar illustrated in FIG. 2 may be provided to assist in installation of the catalyst substrate 50. The guide would engage the peripheral mantle 54 to prevent damage to the relatively soft catalyst substrate 50.

The expression "labyrinth seal" refers to a method of sealing wherein a narrow gap rather than a resilient filler material is used to effect sealing. In a structure such as a catalytic converter, while it may be important to avoid exhaust gas escape from the housing 22, perfect sealing is not required within the chamber 30. The labyrinth seal 80 relies on the tendency of a fluid to seek the path of least resistance. As resistance to flow increases exponentially with fluid velocity, a narrow gap will not pass a significant amount of fluid at high velocities. Hence, in the present case, the fluid flow will substantially be through the passages 52 through the catalyst substrate rather than through the labyrinth seal 80. A typical gap might be on the order of 1 mm nominal with a tolerance of ±½ mm as the peripheral mantle will typically close the gap by approximately ½ mm at operating temperatures.

The reason for having a labyrinth seal 80 adjacent an end wall of the peripheral mantle 54 rather than between the housing 22 and the peripheral outer wall 56 is one of tolerance. The diameter of the peripheral outer wall 56 may be as much as six feet (about 2 metres). Its breadth would typically only be about three inches (about 7.5 cm). Accordingly it will be appreciated that the thermal expansion and contraction of the peripheral mantle 54 will be, in an axial direction, be only a small fraction of what it would be in a radial direction. Accordingly, maintaining a close tolerance between the peripheral mantle 54 and the housing 22 is simpler in the axial rather than the radial direction.

As will be described in more detail below, industrial type catalytic converters are often sized to receive two catalyst substrates 50. In most applications only one is installed and leaving the option of installing a second should one not prove effective enough or should future amendment of relevant regulations impose more stringent standards. Accordingly it is common practise to install a single catalyst substrate 50 adjacent the inlet opening 26 to allow space for a further catalyst substrate 50 to be installed downstream thereof. On this basis, the labyrinth seal is illustrated and described as being upstream of the catalyst substrate 50 toward the inlet opening 26. While this may be the presently preferred arrangement, it is possible to reverse the arrangement and locate the lip 70 and sealing surface 72 adjacent the outlet opening 28 thereby defining the labyrinth seal downstream of the catalyst substrate adjacent the outlet opening. While the latter may not be the preferred arrangement, it should not be dismissed as a possible variant and accordingly the expressions "inlet", "outlet", "forward" and "rearward" both here and in the claims should be considered as preferences rather than as absolutes.

As the catalyst chamber 30 is broader than the peripheral mantle 54, retaining or locating means in the form of a retaining bar 90 is provided to maintain the forward end wall in close juxtaposition to the sealing surface 72. The retaining bar 90 has a forward end 92 and a rearward end 94. The bar has an engaging means in the form of a first tab 96 which abuts against the rearward end wall 60 of the peripheral mantle 54 to limit movement of the peripheral mantle 54 away from the sealing surface 72. While this arrangement has the benefit of not requiring further engaging features on the peripheral mantle 54, it will be appreciated that a tab or slot or other projection could be provided on the peripheral mantle 74 for engaging the first tab 96.

In use catalytic converters are occasionally subject to extreme temperature excursions out of the design norm, such as may be associated with engine malfunction. Ideally such should not damage the catalyst substrate 50 or the housing 22 as repair and/or replacement of these is very expensive and is further associated with costly downtime. Accordingly, the retaining bar 90 should be configured so as not to transfer destructive stresses to the peripheral mantle 54 or the housing 22. This can be achieved by making the first tab 96 of a small enough cross-section to bend in response to axial loading rather than to damage the peripheral mantle 54.

The retaining bar 90 may also be provided with a rearward retaining means in the form of a longitudinal slot 98 of its rearward end 94 to allow for axial growth of the housing 22. Forward retaining means in the form of a transversely extending slot 100 may be provided at the forward end 92 of the retaining bar 90. The transversely extending slot 100 accommodates radial expansion of the peripheral mantle 54 while maintaining it close up against the sealing surface 72.

In cases where a second catalyst substrate 50 is installed, a second tab 102 may be provided on the retaining bar 90 adjacent the first tabs 96. The second tab 102 principally keeps the two catalyst substrates 50 separated rather than keeping the second substrate 50 in sealing engagement with the housing 22.

To avoid crack initiation and propagation a circular hole 104 may be provided at the origin of a partition line 104 between the first tab 96 and second tab 102. A mark such as the numeral "1" identified by reference 106 may be provided to indicate which end of the retaining bar 90 is the forward end. Other markings might include "F" for "forward" or "U" for "upstream".

The above description is intended in an illustrative rather than a restrictive sense. Accordingly, the scope of the invention should not be restricted to the specific embodiments described as variants may be apparent to persons skilled in such structures without departing from the spirit and the scope of the invention as defined by the claims which are set out below.

PARTS LIST

20 catalytic converter
22 housing
24 centre section
26 inlet opening
28 outlet opening
30 catalyst chamber
32 flow path
40 lateral access port
50 catalyst substrate
52 passages (through substrate)
54 peripheral mantle
56 peripheral outer wall
58 forward end wall
60 rearward end wall
70 lip
72 sealing surface
76 guide
80 labyrinth seal
90 retaining bar
92 forward end (of bar)
94 rearward end (of bar)
96 first tab
98 longitudinal slot
100 transverse slot
102 second tab
104 circular hole
106 mark

The invention claimed is:

1. A catalytic converter comprising:

housing having sidewalls defining a catalyst chamber, an inlet opening and an outlet opening communicating with an interior of said catalyst chamber to provide a fluid flow path through said housing from said inlet opening through said chamber and out of said outlet opening;

a catalyst substrate mounted in said chamber and having a flow direction aligned with said fluid flow path, said catalyst substrate having a peripheral mantle extending thereabout, said peripheral mantle having a peripheral outer wall and a pair of spaced-apart end walls extending inwardly therefrom, said catalyst substrate being disposed between said end walls with one of said end walls being a forward end wall upstream of said catalyst substrate and facing toward said inlet opening, the other of said end walls being a rearward end wall downstream of said catalyst substrate and facing toward said outlet opening;

said housing having a sealing surface in said chamber transverse to said flow direction and facing said forward end wall of said peripheral mantle;

locating means secured to said housing for locating said catalyst substrate relative to said chamber, said locating means including engaging means for engaging said peripheral mantle to limit movement of said catalyst substrate away from said sealing surface and maintain said forward end wall in closely spaced arrangement with said sealing surface to define a labyrinth seal therebetween and avoid fluid leakage between said housing and said catalyst substrate to promote fluid flow through said substrate; and said chamber further having a lateral access port through said housing for removal/installation of said catalyst substrate therein without axial separation of said housing.

2. A catalytic converter as claimed in claim 1 wherein said locating means further comprises:

a retaining bar having forward and rearward securing means respectively at forward and rearward ends thereof for securing said bar to said housing;

wherein said engaging means is a tab extending from a side of said bar for abutting against said rearward end wall of said peripheral mantle, said tab being dimensioned to bend at a force input below that required to damage the peripheral mantle.

3. A catalytic converter as claimed in claim 2 wherein:

said forward securing means is configured to accommodate laterally outward movement of said peripheral mantle in response to thermal expansion of said peripheral mantle; and, said rearward securing means is configured to accommodate a longitudinal expansion of said housing.

4. A catalytic converter as claimed in claim 3 wherein:

said forward securing means is a transversely extending slot; and, said rearward securing means is a longitudinally extending slot.

5. A catalytic converter as claimed in claim 4 wherein:

said catalyst chamber accommodates first and second axially aligned catalyst substrates, said first substrate being upstream of said second substrate;

each of said first and second catalyst substrates has a respective said peripheral mantle extending thereabout with respective said forward and rearward end walls;

said locating means includes a first tab and a second tab adjacent said first tab;

said first tab engages said rearward wall of said first catalyst substrate to limit movement of said first catalyst substrate away from said sealing surface of said housing; and, said second tab engages said forward wall of said second catalyst substrate to limit movement of said second catalyst substrate toward said first catalyst substrate.

6. The catalytic converter of claim 5 wherein said locating means is marked to distinguish said forward end from said rearward end.

7. The catalytic converter of claim 6 wherein said locating means is marked with the numeral "1" between said first tab and said forward end.

* * * * *